US010786051B2

(12) United States Patent
Fukuyama et al.

(10) Patent No.: US 10,786,051 B2
(45) Date of Patent: Sep. 29, 2020

(54) ELEMENT FOR SLIDE FASTENER

(71) Applicant: YKK Corporation, Tokyo (JP)

(72) Inventors: Takahiro Fukuyama, Toyama (JP); Koichi Mikado, Toyama (JP); Yasuharu Yoshimura, Toyama (JP); Tetsuya Katsumi, Toyama (JP); Tatewaki Ido, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/553,796

(22) PCT Filed: Mar. 27, 2015

(86) PCT No.: PCT/JP2015/059786
§ 371 (c)(1),
(2) Date: Aug. 25, 2017

(87) PCT Pub. No.: WO2016/157337
PCT Pub. Date: Oct. 6, 2016

(65) Prior Publication Data

US 2018/0049520 A1 Feb. 22, 2018

(51) Int. Cl.
*A44B 19/24* (2006.01)
*C22C 9/04* (2006.01)
(Continued)

(52) U.S. Cl.
CPC ..... *A44B 19/02* (2013.01); *A44B 19/24* (2013.01); *A44B 19/403* (2013.01); *C22C 21/08* (2013.01)

(58) Field of Classification Search
CPC ..... A44B 19/403; A44B 19/24; A44B 19/02; C22C 21/08
See application file for complete search history.

(56) References Cited

U.S. PATENT DOCUMENTS 4,531,977 A * 7/1985 Mishima ..... C22C 21/06 148/551
5,469,605 A * 11/1995 Horikawa ..... A44B 19/34 139/384 B (Continued)

FOREIGN PATENT DOCUMENTS

CN 1609247 A * 4/2005
CN 1609247 A 4/2005

(Continued)

OTHER PUBLICATIONS

R.B.C. Cayless, Alloy and Temper Designation Systems for Aluminum and Aluminum Alloys, Copyright 1990, ASM International, vol. 2, p. 20 (Year: 1990).*

(Continued)

*Primary Examiner* — Jason W San
(74) *Attorney, Agent, or Firm* — Kilpatrick Townsend & Stockton LLP

(57) ABSTRACT

Elements for a slide fastener are provided, which have high strength and improved abrasion resistance. More particularly, an element for a slide fastener includes as a base material, an aluminum alloy having a composition represented by a general formula: $Al_aSi_bCu_cMg_d$ in which a, b, c and d are expressed in percentage by mass, a denotes a balance, $0.4 \leq b \leq 0.9$, $0.15 \leq c \leq 0.8$, $0.8 \leq d \leq 2.0$, and unavoidable impurity elements may be contained; and the aluminum alloy containing a precipitate containing Mg and Si.

5 Claims, 2 Drawing Sheets

(51) Int. Cl.

| | |
|---|---|
| ***A44B 19/02*** | (2006.01) |
| ***C22C 21/08*** | (2006.01) |
| ***A44B 19/40*** | (2006.01) |

(56) References Cited

U.S. PATENT DOCUMENTS

| | | | | |
|---|---|---|---|---|
| 5,997,663 | A * | 12/1999 | Kita | C22C 9/05 148/434 |
| 6,340,446 | B1 * | 1/2002 | Kita | C22C 9/05 420/480 |
| 2003/0110600 | A1 * | 6/2003 | Kikukawa | A44B 19/00 24/399 |
| 2003/0110601 | A1 * | 6/2003 | Sugimoto | A44B 19/00 24/436 |
| 2004/0163739 | A1 * | 8/2004 | Kawazoe | C22C 21/06 148/440 |
| 2012/0055591 | A1 | 3/2012 | Kamat et al. | |
| 2013/0047784 | A1 * | 2/2013 | Xu | C22C 19/07 75/232 |
| 2013/0104349 | A1 * | 5/2013 | Yoshimura | C22C 9/04 24/415 |
| 2014/0017512 | A1 | 1/2014 | Iimori et al. | |
| 2015/0218674 | A1 * | 8/2015 | Kido | A44B 19/00 420/482 |
| 2017/0349976 | A1 * | 12/2017 | Yoshimura | C22C 9/04 |
| 2018/0171453 | A1 * | 6/2018 | Leyvraz | C22C 21/04 |
| 2018/0185968 | A1 * | 7/2018 | Grong | B23K 35/28 |
| 2018/0187293 | A1 * | 7/2018 | Shishido | C22C 21/02 |

FOREIGN PATENT DOCUMENTS

| | | | |
|---|---|---|---|
| CN | 101280400 | A | 10/2008 |
| JP | 61-246341 | A | 11/1986 |
| JP | 2004-183025 | A | 7/2004 |
| JP | 2004-250760 | A | 9/2004 |
| JP | 2006-291298 | A | 10/2006 |
| JP | 2013-542320 | A | 11/2013 |
| JP | 2014-019953 | A | 2/2014 |

OTHER PUBLICATIONS vol. 2B, Kevin Anderson et al., 6061 and Alclad 6061 General Structural Alloy, Jun. 2019, pp. 388-393 (Year: 2019).*

International Search Report, PCT International Patent Application No. PCT/JP2015/059786, dated Jun. 16, 2015.

Office Action, Chinese Patent Application No. 20158078346.6, dated Sep. 4, 2019.

Office Action, Chinese Patent Application No. 201580078346.6, dated Apr. 16, 2020.

* cited by examiner

ELEMENT FOR SLIDE FASTENER

This application is a national stage application of PCT/JP2015/059786, which is incorporated herein by reference.

TECHNICAL FIELD

The present invention relates to an element for a slide fastener.

BACKGROUND ART

Conventionally, copper-zinc alloys such as red brass and brass, and copper-zinc-nickel alloys such as nickel silver are mainly used for constituent parts of slide fasteners, for example. These alloys have colors specified by materials used, such as copper color, gold color and silver color. Recently, the slide fasteners have been required for having appearance designs also in terms of their applications to be used, and there has been a need for providing parts having various colors.

On the other hand, slide fasteners having various colors are known, such as those obtained by subjecting elements (teethes) made of aluminum or an alloy thereof to an electrochemical surface treatment such as an anodizing treatment, electroplating and electrodeposition coating.

However, when the electrochemical surface treatment is performed on the existing aluminum alloy (for example, JIS 5183 or the like), elements for a slide fastener tend to be obtained which have various colors with poor metallic luster, and when the alloy composition is adjusted so as to focus on the metallic luster or when the existing aluminum alloy (for example, JIS 5052, 5056, 5154, etc.) is selected, mechanical properties required for intended use, in particular strength, are deteriorated, so that restraints will be imposed in terms of practical use.

Patent Document 1 discloses an aluminum alloy with improved decorativeness, the aluminum alloy having a composition represented by the general formula: $Al_aMg_b$-$Mn_cCr_d$ in which a, b, c and d each presents percent by mass, a represents the balance, $3.0 \le b \le 5.6$, $0.05 \le c \le 1.0$, $0.05 \le d \le 0.7$ and $c+d>0.2$, and unavoidable impurity elements may be contained; the alloy having a matrix substantially consisting of a solid solution of aluminum and having a structure with no β phase. This document also discloses that slide fastener parts obtained from the alloy have mechanical properties such as strength and hardness.

Patent Document 2 discloses at least one member selected from the group consisting of components, elements, stoppers, a pull tab and a slider for a slide fastener, made of the following four aluminum alloys:

(1) an aluminum alloy having a composition represented by the general formula: $Al_aMg_bCu_c$ in which a, b and c represent % by mass, a is the balance, $4.3 \le b \le 5.5$ and $0.5 \le c \le 1.0$, and unavoidable impurities may be contained;

(2) an aluminum alloy having a composition represented by the general formula: $Al_dMg_eCu_fX_g$ in which X is Mn and/or Cr, and d, e, f and g represent % by mass, and d is the balance, $4.3 \le e \le 5.5$, $0.5 \le f \le 1.0$, and $0.05<g \le 0.2$, and unavoidable impurities may be contained;

(3) an aluminum alloy having a composition represented by the general formula: $Al_h\ Mg_iCu_jZn_k$ in which h, i, j and k represent % by mass, and h is the balance, $4.3 \le i \le 5.5$, $0.5 \le j \le 1.0$, and $0<k \le 1.0$, and unavoidable impurities may be contained; and further satisfying the relational expression: $j+k \le 1.5$;

(4) an aluminum alloy having a composition represented by the general formula: $Al_lMg_mCu_n\ Zn_p\ X_q$ in which X is Mn and/or Cr, and l, m, n, p and q represent % by mass, and l is the balance, $4.3 \le m \le 5.5$, $0.5 \le n \le 1.0$, $0<p \le 1.0$, and $0.05<q \le 0.2$, and unavoidable impurities may be contained; and further satisfying the relational expression: $n+p \le 1.5$.

PRIOR ART DOCUMENT

[Patent Document 1] Japanese Patent Application Public Disclosure (KOKAI) No. 2004-250760A1

[Patent Document 2] Japanese Patent Application Public Disclosure (KOKAI) No. 2006-291298 A1

SUMMARY OF THE INVENTION

Problem to be Solved by the Invention

The elements for the slide fastener using the conventional aluminum alloy have suffered from a problem that the elements do not have sufficient strength, so that it is difficult to use them for articles such as pants for which strength will be required. Further, abrasion by the slider or friction between the elements may generate black abrasion powders, so that the clothing and the like may become dirty. Furthermore, there has been a problem that an increased amount of abrasion weakens the engagement between the elements, so that crosswise strength of the elements is also decreased.

The aluminum alloys described in Patent Documents 1 and 2 are of a solid solution strengthened type. Therefore, there has been a problem that if the strength is improved by increasing the amount of solid solution and by cold rolling, the workability is decreased, and strain removal by a heat treatment during working is required to obtain the element shape, so that the strength is lowered.

Therefore, an object of the present invention is to provide elements for a slide fastener, which having high strength and improved abrasion resistance.

Means for Solving the Problem

The inventors have made intensive investigations to achieve the above object, and found that the use of an age-hardening type aluminum alloy in place of the conventional solid solution hardening type aluminum alloy allows heat treatment after cold working for removal of strain to suppresses a decrease in the strength while improving the workability, resulting in improvement of strength as compared with the prior art, and also found that control of the structure and the arrangement of the high hardness precipitates formed during aging by the cold rolling allows improvement of the strength and abrasion resistance as compared with the prior art. The inventors have completed the present invention based on such findings.

Thus, the present invention is as follows:

(1) An element for a slide fastener, the element comprising, as a base material, an aluminum alloy having a composition represented by a general formula: $Al_aSi_b\ Cu_cMg_d$ in which a, b, c and d are expressed in percentage by mass, a denotes the balance, $0.4 \le b \le 0.9$, $0.15 \le c \le 0.8$ and $0.8 \le d \le 2.0$, and unavoidable impurity elements may be contained; and the aluminum alloy containing a precipitate containing Mg and Si.

(2) The element for the slide fastener according to (1), wherein the element comprises a leg portion for clipping the slide fastener, wherein the leg portion has an average of Vickers hardness of 120 Hv to 145 Hv, and wherein standard deviation of the hardness is 2.2 to 4.1.

(3) The element for the slide fastener according to (2), wherein the element comprises the leg portion and an engaging head portion, and wherein in a planner view of the element from a direction both the leg portion and the engaging head portion are visible, when the leg portion is divided into a leg base portion that begins from a groin of the leg portion and corresponds to 70% of a length of a perpendicular line drawn from the groin to a tip of the leg portion; and a leg tip portion that corresponds to a remaining 30%, the leg tip portion has an average of Vickers hardness of 116 Hv to 137 Hv.

(4) The slide fastener element according to any one of (1) to (3), wherein the length of one piece of the precipitate is 1 to 120 nm.

(5) A slide fastener comprising the element for the slide fastener according to any one of (1) to (4).

Effects of the Invention

According to the present invention, an element for a slide fastener which has high strength and improved abrasion resistance can be provided.

MODES FOR CARRYING OUT THE INVENTION

Figure 1:
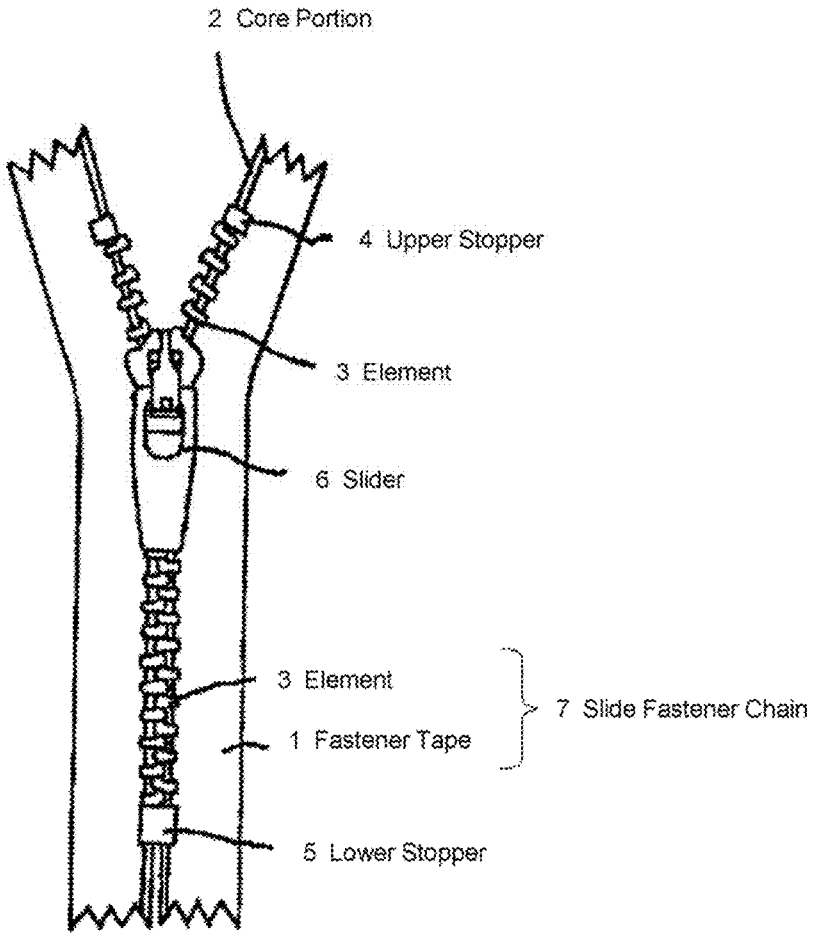
FIG. 1 is a schematic view of a slide fastener.

Hereinafter, the present invention will be described.

(Composition)

The elements for the slide fastener according to the present invention can have high strength and improved abrasion resistance by using a base material with an age-hardening type copper alloy having a predetermined composition.

In an embodiment, the element for the slide fastener according to the present invention comprises the base material of the aluminum alloy having a composition represented by the general formula: $Al_aSi_b\ Cu_cMg_d$ in which a, b, c and d are expressed in percentage by mass, a denotes the balance, $0.4 \le b \le 0.9$, $0.15 \le c \le 0.8$ and $0.8 \le d \le 2.0$, and unavoidable impurity elements may be contained; and the aluminum alloy containing a precipitate containing Mg and Si.

<Si>

Si forms an extremely fine intermetallic compound with Mg by dissolving in an Al matrix and then performing an aging heat treatment, so that Si has an effect of improving mechanical properties (strength, hardness) of the alloy.

The composition ratio (b) of Si is 0.4 (% by mass)≤b≤0.9 (% by mass), i.e., 0.4% by mass or more and 0.9% by mass or less, and preferably 0.4% by mass or more and 0.8% by mass or less. If the composition ratio of Si is too low, the strength and hardness of the aluminum alloy will be difficult to improve. On the other hand, if it is too high, coarse precipitation or crystallization of elemental Si will be promoted and elongation in plastic deformation will be decreased, thereby deteriorating the workability. Further, the addition of an appropriate amount of Si allows prevention of softening in a heating step (water washing, drying, and the like) after cold working. In particular, the atoms (Si) precipitated in the Al matrix by the aging heat treatment prevent migration of dislocations introduced by cold rolling, so that reduction of strength due to the heat treatment can be suppressed. In a case where the composition ratio of Si is too low, the sufficient effect will not be obtained, whereas in a case where it is too high, the cold workability will be deteriorated, so that both cases are not particularly suitable for fastener materials.

<Cu>

Cu forms an extremely fine precipitate by dissolving in the Al matrix and then performing the aging heat treatment, so that Cu has an effect of improving mechanical properties (strength, hardness) of the alloy.

The composition ratio (c) of Cu is 0.15 (% by mass) ≤c<0.8 (% by mass), i.e., 0.15% by mass or more and less than 0.8% by mass, and preferably 0.15% by mass or more and 0.4% by mass or less. Further, the addition of an appropriate amount of Cu allows prevention of softening during a heating step (water washing, drying, and the like) after cold working. In particular, the atoms (Cu) precipitated in the Al matrix by the aging heat treatment prevent migration of dislocations introduced by cold rolling, so that reduction of strength due to the heat treatment can be suppressed. In a case where the composition ratio of Cu is too low, the sufficient effect will not be obtained, whereas in a case where it is too high, the cold workability and corrosion resistance will be deteriorated, so that both cases are not particularly suitable for fastener materials.

<Mg>

Mg forms an extremely fine intermetallic compound with Si by performing a heat treatment, so that Mg has an effect of improving mechanical properties (strength, hardness) of the alloy. Mg also has an effect of improving mechanical properties (strength, hardness) of the alloy by dissolving in the Al matrix.

The composition ratio (d) of Mg is 0.8 (% by mass)≤d≤2.0 (% by mass), i.e., 0.8% by mass or more and 2.0% by mass, and preferably 0.8% by mass or more and 1.2% by mass or less. Further, the addition of an appropriate amount of Mg allows prevention of softening during a heating step (water washing, drying, and the like) after cold working. In particular, the atoms (Mg) precipitated in the Al matrix by the aging heat treatment prevent migration of dislocations introduced by cold rolling, so that reduction of strength due to the heat treatment can be suppressed. In a case where the composition ratio of Mg is too small, the sufficient effect will not obtained, whereas in a case where it is too large, the cold workability will be poor, both cases of which are not particularly suitable for fastener materials.

<Unavoidable Impurities>

The unavoidable impurities refer to generally acceptable impurities because although they are inherently unnecessary substances in metal products, which may be present in raw materials or inevitably mixed in producing steps, they are present in a minor amount and have no effect on the metal products. In the present invention, the content of each impurity element accepted as unavoidable impurities is generally 0.1% by mass or less, and preferably 0.05% by mass or less. In addition, other elements having higher contents than unavoidable impurities may include Fe of 0.7% by mass or less, Mn of 0.15% by mass or less, Cr of 0.35% by mass or less, and Zn of 0.25% by mass or less, which are acceptable in terms of the application of the elements for the slide fastener.

(Strength and Workability)

In an embodiment of the slide fastener element according to the present invention, the average of Vickers hardness of the leg portion is 120 Hv or more and 145 Hv or less (according to JIS 2244: 2009; the same applies hereinafter). The Vickers hardness in this range is preferred in that sufficient strength can be obtained to function as elements for the metallic fastener while maintaining the life of a molding die.

In the elements for the slide fastener of the present invention, their shapes are provided by subjecting a round wire made of the aluminum alloy having the above composition to cold working. When the shape of the element is provided by the cold working, working strain is introduced into the round wire made of the aluminum alloy and strength of the material is increased by work hardening, so that strength of the element can be obtained. The strength and workability of the element may vary depending on the working strain to be introduced into the round wire made of the aluminum alloy. Therefore, this is important to obtain the strength and workability of the element.

If the working strain introduced into the round wire made of the aluminum alloy is too small, the work hardening degree will be decreased so that the strength of the element cannot be obtained. Conversely, if the working strain is excessively large, the workability will be deteriorated so that the life of the molding die is decreased, and in some cases, cracks may be generated in the element due to working limit, so that the function as the element for the slide fastener is impaired.

To produce the slide fastener elements that exert the strength as described above, the working strain introduced into the aluminum alloy should be 70% or more in terms of a rolling reduction rate, and preferably 80% or more. The rolling reduction rate is a rolling reduction rate at the final rolling of the slide fastener element, and is, for example, a rolling reduction rate when processing the Y-shaped continuous deformed wire by cold rolling, as in Examples as described below.

In the element for the slide fastener of the present invention, the leg portion for clipping the slide fastener preferably has hardness equal to or more than a certain value and less variation of the hardness, and more particularly, the leg portion has Vickers hardness of 120 Hv to 145 Hv, and preferably 125 Hv to 145 Hv, and the standard deviation of the hardness of 2.2 to 4.1.

Further, in a planner view of the element from a direction both the leg portion and an engaging head portion (which is for engaging the adjacent elements fixed to the fastener tapes in a manner as stated below according to opening and closing operation of the fastener) are visible, when the leg portion is divided into a leg base portion that begins from a groin of the leg portion and corresponds to 70% of the length of a perpendicular line drawn from the groin to a tip of the leg portion; and a leg tip portion that is a portion corresponding to a remaining 30%, it was difficult for the prior art to have a hard leg tip portion. This was one of the causes of falling off of the elements from the fastener tape during opening and closing operation of the fastener. Therefore, it is preferable that the hardness of the leg tip portion is also equal to or more than a certain value. From this viewpoint, an average of the Vickers hardness of the leg tip portion is preferably 116 Hv to 137 Hv, and preferably 120 Hv to 137 Hv.

In order to realize such strength, it is preferable that in the aluminum alloy which is the base material of the elements for the slide fastener, the precipitate containing Mg and Si is a needle-like substance, and more specifically, the length of one piece of the precipitate is preferably 1 to 120 nm. The size of the precipitate can be measured by observation with a transmission electron microscope.

(Production Method)

The aluminum alloy having the above composition, for example, the aluminum alloy A6061 according to JIS H 4000, is subjected to a T8 treatment (a solution treatment, followed by cold working, and further followed by artificial aging hardening treatment, for example a heating treatment at 170° C. for approximately 5 to 6 hours), and the treated aluminum alloy can be suitably used. Using a wire material made of the aluminum alloy after the T8 treatment, working strain at a predetermined reduction rate is introduced by cold rolling to produce a continuous deformed wire having a substantially Y-shaped cross section. Further, the deformed wire is subjected to various cold working such as cutting, pressing, bending and caulking to provide elements for the slide fastener, each having a predetermined shape and size.

(Surface Treatment)

The elements for the slide fastener according to the present invention may be optionally subjected to various surface treatments. For example, the elements may be subjected to a smoothing treatment, a rust preventive treatment, a painting treatment, a plating treatment and the like.

(Slide Fastener)

Examples of the slider fastener comprising the elements for the slide fastener according to the present invention will be described with reference to Figures. FIG. 1 is a schematic view of the slide fastener. As shown in FIG. 1, the slide fastener comprises a pair of fastener tapes 1 each having a core portion 2 formed on one side edge; elements 3 attached and fixed to the core portion 2 of each fastener tape 1 by means of caulking and arranged at a predetermined space on the core portion 2; upper stoppers 4 and a lower stopper 5 fixed to the core portion 2 of each fastener tape 1 by means of caulking at the upper end and the lower end of the row of elements 3, respectively; and a slider 6 arranged between a pair of opposing elements 3 and slidable in the up and down direction so as to engage and disengage the pair of the elements 3. An article in which the elements 3 have been attached on the core portion 2 of one fastener tape 1 is referred to as a slide fastener stringer, and an article in which the elements 3 attached to the core portions 2 of a pair of fastener tapes 1 have been engaged with each other is referred to as a slide fastener chain 7.

Further, the slider 6 shown in FIG. 1 is obtained by subjecting a long body (not shown) made of a plate-like body having a rectangular cross section to press working in multiple stages and cutting the long body at predetermined intervals to prepare a slider body, and by further attaching a spring and a pull tab to the slider body as necessary. Furthermore, the pull tab is obtained by stamping out the plate-like body having the rectangular cross section into a predetermined shape, and the pull tab is fixed to the slider body by means of caulking. It is noted that the lower stopper 5 may be an openable, closable and fittingly insertable tool including an insert pin, a box pin and a box body, so that the pair of slide fastener chains can be separated by separating operation of the slider.

Figure 2:
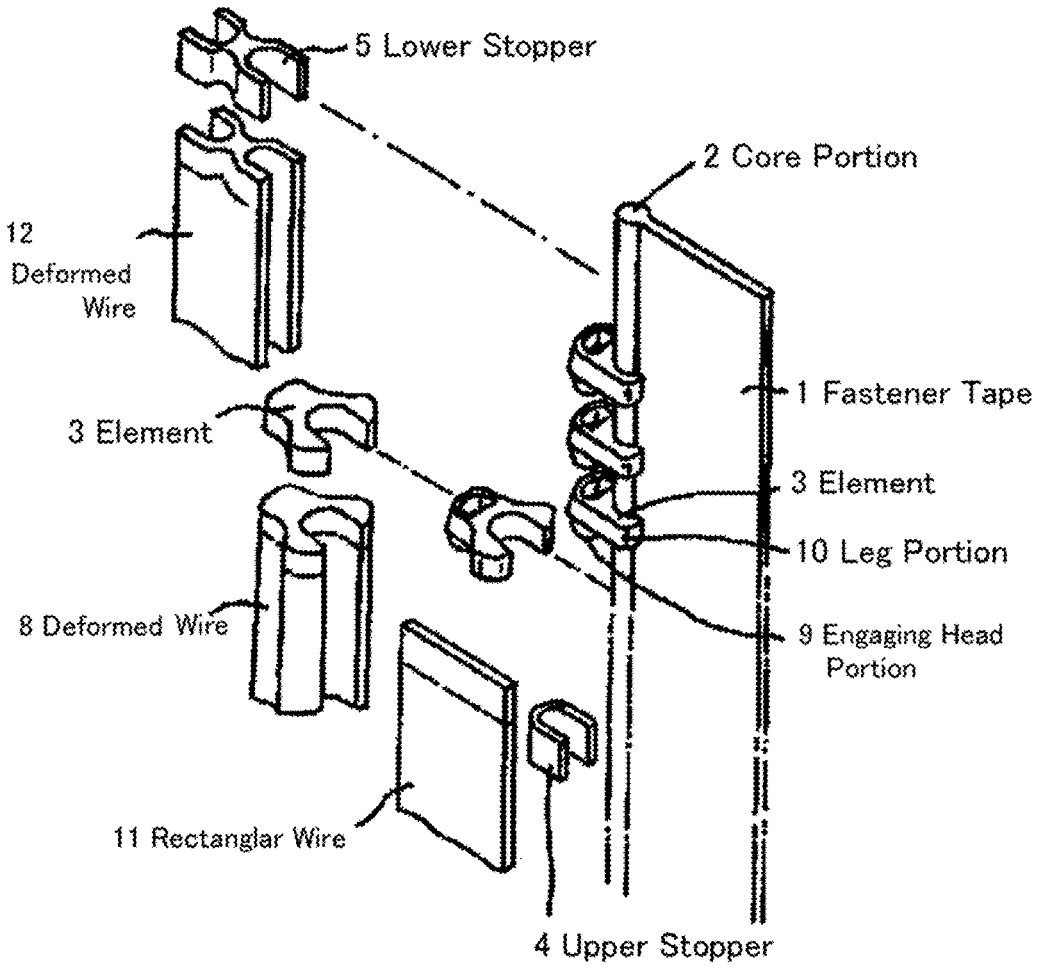
FIG. 2 is a view for explaining how to attach a lower stopper, upper stoppers and elements to a fastener tape.

FIG. 2 is a view showing a method for assembling the elements 3, the upper stoppers 4 and the lower stopper 5 for the slide fastener as shown in FIG. 1 and how to attach these members to the core portion 2 of the fastener tape 1. As shown in FIG. 2, the elements 3 are formed by cutting a deformed wire 8 having a substantially Y-shaped cross section into pieces each having a predetermined dimension, and pressing the pieces to form an engaging head portion 9, and the elements are then attached to the core portion 2 by caulking both the leg portion 10 onto the core portion 2 of the fastener tape 1.

The upper stopper 4 is formed by cutting a rectangular wire 11 (flat wire) having a rectangular cross section into pieces each having a predetermined dimension, and bending the pieces to form a substantially U-shaped cross section, and is then attached to the core portion 2 by caulking the piece onto the core portion 2 of the fastener tape 1. The lower stopper 5 is formed by cutting a deformed wire 12 having a substantially X-shaped cross section 12 into pieces each having a predetermined dimension, and is then attached to the core portion 2 by caulking the piece onto the core portion 2 of the fastener tape 1.

It is noted that FIG. 2 seems to show the elements 3, the upper stopper 4 and the lower stopper 5 are simultaneously attached to the fastener tape 1, however, actually, the elements 3 are first attached continuously to the fastener tape 1 to form a fastener chain, the elements 3 placed in attaching regions for the stoppers in the fastener chain are removed, and the predetermined upper and lower stoppers 4, 5 are then attached in these regions adjacent to the elements 3. Since the production and attachment are performed in such a way, the elements and the stoppers which are components the slide fastener members should have good cold workability. In this regard, the metallic fastener members according to the present invention have good cold workability, and for example, they can be formed with a rolling reduction of 70% or more. Therefore, they are suitable as materials for the elements and the upper and lower stoppers.

The slide fastener according to the present invention can be attached to various articles, and particularly functions as an opening/closing tool. The articles to which the slide fastener is attached include, but not limited to, daily necessities such as clothes, bags, shoes and miscellaneous goods, as well as industrial goods such as water storage tanks, fishing nets and space suites.

EXAMPLES

Hereinafter, Examples of the present invention are illustrated, but they are provided for better understanding of the present invention and its advantages, and are not intended to limit the present invention.

<Preparation of Fastener Chain>

Using Al (purity of 99.99% by mass or more), Cu (purity of 99.9% by mass or more), Mg (purity of 99.9% by mass or more) and Si (purity of 99.9% by mass or more) as raw materials, these raw materials were blended so as to have each alloy composition according to the test number as shown in Table 1, and melted in a casting machine, and a rod material was then produced by an extrusion device. The resulting rod material was subjected to a wire drawing treatment with an area reduction rate of 70% or more, and subjected to a solution treatment by performing a heat treatment at a temperature range of 500° C. to 600° C. for 1 to 6 hours immediately followed by quenching. The wire was then subjected to a wire drawing treatment with an area reduction rate of 1% or more, which was then subjected to an artificial aging treatment (T8 treatment) by performing a heat treatment at a temperature range of 100° C. to 200° C. for 1 to 12 hours to prepare a continuous wire. The resulting continuous wire was subjected to cold rolling to provide working strains of a rolling reduction rate of 70% or more to produce a continuous deformed wire having a substantially Y-shaped cross section, which was then subjected to various cold working processes such as cutting, pressing, bending and caulking to form elements each having the dimension of "5R" as defined in the catalog "FASTENING SENKA (issued by YKK Co., Ltd. on February 2009)". The elements were then attached to a polyester fastener tape to form a fastener stringer. Furthermore, the opposing elements of a pair of fastener stringers were engaged with each other to form a fastener chain.

<Tensile Strength, Yield Strength, Elongation>

A tensile test specimen (No. 9A specimen) was cut out from the wire material immediately after the T8 treatment in a direction parallel to the rolling direction, and the tensile strength (according to JIS Z 2241: 2011) was measured. Results are shown in Table 1.

TABLE 1

| | Composition (% by mass) | | | | | | | | Mechanical Properties | | |
|---|---|---|---|---|---|---|---|---|---|---|---|
| | | | | | | | | | Tensile Strength | Yield Strength | Elongation |
| | Si | Fe | Cu | Mn | Mg | Cr | Zn | Ti | (N/mm2) | (N/mm2) | (%) |
| EX. 1 | 0.57 | 0.32 | 0.28 | 0.08 | 0.93 | 0.23 | 0.04 | 0.03 | 383 | 349 | 10 |
| EX. 2 | 0.73 | 0.19 | 0.35 | 0.03 | 1.11 | 0.13 | 0.01 | 0.04 | 330 | | 8 |
| EX. 3 | 0.57 | 0.29 | 0.29 | 0.05 | 0.89 | 0.2 | 0.06 | 0.03 | 370 | 347 | 10 |
| EX. 4 | 0.69 | 0.17 | 0.34 | 0.02 | 1.12 | 0.12 | 0.01 | 0.04 | 321 | | 75 |
| EX. 5 | 0.48 | 0.3 | 0.29 | 0.03 | 0.98 | 0.18 | 0.08 | 0.02 | 383 | 349 | 10 |
| COMP. 1 | 0.12 | 0.16 | 0.002 | 0.058 | 4.78 | 0.062 | 0.004 | 0.029 | 290 | 150 | 32 |

For the fasteners made from each aluminum alloy, the following test was conducted:

<Hardness Test>

For each element obtained from the aluminum alloys each having the composition corresponding to the test number, Vickers hardness (according to JIS Z 2244: 2009; the load was 0.9807 N) at a plurality of places in the leg portion (the leg base portion and the leg tip portion) was measured, and the average value of the hardness was obtained. The standard deviation (SD) of the Vickers hardness in each portion was also obtained. Results are shown in Table 2.

<Abrasion Test>

According to the method described in the "reciprocating opening and closing durability test" in JIS S3015: 2007, opening and closing operations were performed 2000 times with reciprocating opening and closing loading of L rank (9.8 N in the lateral direction; 6.9 N in the longitudinal direction). The testing was stopped when the elements could not be engaged, or cutting of the tape portion, cracking of the engaged elements and/or falling off of the elements were visually observed, during the testing. Results are shown in Table 3.

<Chain Crosswise Strength>

Evaluation of the chain crosswise strength as an index of the strength of the fastener was conducted in accordance with the method described in the "reciprocating opening and closing durability test" in JIS S 3015: 2007.

Results are shown in Table 3.

TABLE 2

| | Product Characteristic Hardness Distribution (Hv) | | | | | | | | | | | | | | | |
|---|---|---|---|---|---|---|---|---|---|---|---|---|---|---|---|---|
| | Whole | | | | Leg Portion | | | | Leg Base Portion | | | | Leg Tip Portion | | | |
| | Ave. | max | min. | SD | Ave. | max | min. | SD | Ave. | max | min. | SD | Ave. | max | min. | SD |
| EX. 1 | 131 | 141 | 113 | 5 | 132 | 141 | 113 | 4.9 | 135 | 141 | 123 | 3.2 | 128 | 136 | 113 | 4 |
| EX. 2 | 138 | 142 | 124 | 3.1 | 138 | 141 | 124 | 2.9 | 134 | 141 | 128 | 2.5 | 131 | 140 | 124 | 3 |
| EX. 3 | 127 | 139 | 113 | 4.6 | 128 | 139 | 113 | 4.9 | 131 | 139 | 122 | 3.4 | 124 | 130 | 113 | 3.4 |
| EX. 4 | 123 | 134 | 115 | 3.5 | 123 | 134 | 115 | 3.7 | 125 | 134 | 117 | 3 | 120 | 129 | 115 | 3.2 |
| EX. 5 | 127 | 137 | 117 | 3.9 | 128 | 137 | 119 | 4.3 | 131 | 137 | 123 | 3.3 | 124 | 131 | 119 | 2.5 |
| COMP. 1 | 121 | 138 | 104 | 7.2 | 120 | 138 | 104 | 10 | 123 | 138 | 113 | 12 | 115 | 128 | 104 | 14 |

TABLE 3

| | Product Characteristic | | | | | |
|---|---|---|---|---|---|---|
| | Chain Crosswise Strength N | | | Reciprocating Opening/ Closing Durability Grade L, 2000 times, Stop | | |
| | Ave. | max. | min. | Ave. | max. | min. |
| EX. 1 | 634 | 672 | 570 | 1269 | 2000 | 653 |
| EX. 2 | 621 | 645 | 596 | 823 | 1197 | 610 |
| EX. 3 | 625 | 650 | 597 | 915 | 1724 | 547 |
| EX. 4 | 599 | 624 | 552 | 513 | 655 | 392 |
| EX. 5 | 607 | 666 | 545 | 831 | 1417 | 399 |
| COMP. 1 | 564 | 580 | 536 | 535 | 709 | 255 |

DESCRIPTION OF REFERENCE NUMERALS

1 fastener tape
2 core portion
3 element
4 upper stopper
5 lower stopper
6 slider
7 slide fastener chain
8 deformed wire having a Y-shaped cross section
9 engaging head portion
10 leg portion
11 rectangular wire
12 deformed wire having an X-shaped cross section

What is claimed is:

1. An element for a slide fastener, the element comprising, as a base material, an aluminum alloy having a composition represented by $Al_aSi_bCu_cMg_d$ in which a, b, c and d are expressed in percentage by mass, a denotes a balance, $0.4 \leq b \leq 0.9$, $0.15 \leq c \leq 0.8$, $0.8 \leq d \leq 2.0$, and unavoidable impurity elements wherein, the unavoidable impurity elements include Fe of 0.7% by mass or less, Mn of 0.15% by mass or less, Cr of 0.35% by mass or less, and Zn of 0.25% by mass or less, and any other unavoidable impurity elements of 0.1% by mass or less; and the aluminum alloy containing a precipitate containing Mg and Si, wherein the element comprises a leg portion for clipping the slide fastener, wherein the leg portion has an average of Vickers hardness of 120 Hv to 145 Hv based on a plurality of measurements at a plurality of different places on a surface of the leg portion, the plurality of different places including at least one place on a leg base portion and a plurality of different places on a leg tip portion.

2. The element for the slide fastener according to claim 1, wherein the element comprises the leg portion for clipping the slide fastener, wherein the leg portion has an average of Vickers hardness of 125 Hv to 145 Hv based on the plurality of measurements at the plurality of different places on the surface of the leg portion, and wherein standard deviation of the Vickers hardness is 2.2 to 4.1.

3. The element for the slide fastener according to claim 2, wherein the element comprises the leg portion and an engaging head portion, and wherein in a planner view of the element from a direction both the leg portion and the engaging head portion are visible, when the leg portion is divided into the leg base portion that begins from a groin of the leg portion and corresponds to 70% of a length of a perpendicular line drawn from the groin to a tip of the leg portion; and the leg tip portion that corresponds to a remaining 30%, the leg tip portion has an average of Vickers hardness of 116 Hv to 137 Hv, based on a plurality of measurements at the plurality of different places on the leg tip portion.

4. The element for the slide fastener according to claim 1, wherein the precipitate includes a plurality of pieces and a length of one piece of the precipitate is 1 to 120 nm.

5. A slide fastener comprising the element for the slide fastener according to claim 1.

* * * * *